US005861794A

United States Patent [19]

Pellon

[11] Patent Number: 5,861,794

[45] Date of Patent: Jan. 19, 1999

[54] THERMAL CIRCUIT BREAKER APPARATUS

[75] Inventor: Christian V. Pellon, Norton, Mass.

[73] Assignee: Texas Instruments Incorporated, Dallas, Tex.

[21] Appl. No.: 72,493

[22] Filed: May 4, 1998

[51] Int. Cl.[6] ..... H01H 71/16; H01H 37/54

[52] U.S. Cl. ..... 337/365; 337/348; 337/362; 337/380

[58] Field of Search ..... 337/380, 348, 337/362, 365, 356, 75, 72, 79, 112, 358, 359

[56] References Cited

U.S. PATENT DOCUMENTS

| | | | |
|---|---|---|---|
| 2,696,538 | 12/1954 | O'Neill . | |
| 3,686,601 | 8/1972 | Kaczmarek et al. | 337/66 |
| 3,913,049 | 10/1975 | Burch | 337/75 |
| 3,924,213 | 12/1975 | Semple | 337/130 |
| 4,039,991 | 8/1977 | Bucheister | 337/348 |
| 4,371,859 | 2/1983 | Sorimachi | 337/365 |
| 4,480,246 | 10/1984 | Schmitt | 337/348 |

*Primary Examiner*—Leo P. Picard
*Assistant Examiner*—Anatoly Vortman
*Attorney, Agent, or Firm*—Russell E. Baumann; Richard L. Donaldson; René E. Grossman

[57] ABSTRACT

An open ended cup shaped housing (12) has first and second spaced electric terminals (14,16) extending through the bottom wall of the housing into a switch chamber with a snap acting, current carrying disc (18) cantilever mounted on one terminal and having a movable contact (20) movable into and out of engagement with a stationary contact (22) mounted on the other terminal. A reset member (28) is received in the housing and has a first leg **(28*b*) formed with a catch (28*g*) normally biased against the edge of the disc with the catch receivable under the disc upon opening of the contacts. A force applying member (32, 38) is mounted on a lid and upon depression applies a force through a flexible, environmental gasket disposed across the open end of the housing causing a second leg (28*c*) to displace the catch and allow the contacts to reengage. In a modified embodiment a two piece (34, 36) reset member is shown. A momentary break is shown having a pivotable arm (44) which has an end (44*c*) with a reverse bend received under the free end of the disc and a force receiving surface (44*d*) which, when depressed, raises the free end of the disc to separate the contacts. When combined with the manual reset member (28) the switch arm (44)** forms a manually switchable device in which the catch moves under the disc when the edge of the disc is raised through thermally caused snap action or manual lifting of the disc.

13 Claims, 11 Drawing Sheets

THERMAL CIRCUIT BREAKER APPARATUS

FIELD OF THE INVENTION

This invention relates generally to electrical circuit breakers and more particularly to circuit breakers using snap acting, current carrying thermostatic discs.

BACKGROUND OF THE INVENTION

It is conventional to mount a current carrying thermostatic disc in a housing so that it will snap between contacts engaged and contacts disengaged configurations in dependence upon the temperature of the disc. Electrical current passing through the disc generates heat thereby raising the temperature of the disc. Current levels above a selected level will raise the temperature of the disc to a preselected actuation level at which point the disc will snap to a contacts disengaged configuration thereby breaking the electrical circuit until the disc cools off to a lower, reset temperature at which point the disc will automatically snap back to a contacts engaged configuration re-energizing the electrical circuit.

It is also conventional to provide manually resettable circuit breakers by using a thermostatic having a wide temperature differential, that is, a disc having a relatively low reset temperature and provide some mechanism to apply a force to the disc to cause it to reset. A switch of this type is shown in U.S. Pat. No. 2,696,538 by way of example. Such switches work well, however, they require the use of a reset plate and associated parts for applying a relatively high force without interfering with the trip free operation of the switch. That is, it is a requirement of this type of switch that the contacts be allowed to move to a contacts disengaged position even when the reset mechanism is held in the actuated position. This results in relatively complex parts. Further, making wide temperature differential discs is more difficult than making automatic resettable discs having a narrower temperature differential.

Another circuit breaker in commercial use employs an automatically resettable disc along with an electrically insulative, spring loaded member which rotates upon opening of the contacts to be positioned between the contacts to thereby prevent reengagement of the contacts. The circuit breaker is manually reset by rotating a lever attached to the spring loaded member to move the member out of alignment with the contacts. This type of circuit breaker has the disadvantage that the plastic member which drags across the contacts tends to melt and/or deteriorate and contaminate the contacts during repeated cycling thereby adversely effecting proper operation. Another disadvantage is that the lever mechanism penetrates an environmental gasket placed over the circuit breaker housing thereby subjecting the device to leakage of water and the like, a serious disadvantage when the circuit breaker is used in marine applications and the like.

SUMMARY OF THE INVENTION

It is an object of the present invention to provide a trip free, thermal circuit breaker which overcomes the prior art limitations referenced above. Another object is the provision of a circuit breaker which comprises a current carrying thermostatic, snap acting disc which is easily assembled, reliable and one which has an improved environmental seal. Yet another object is the provision of such a circuit breaker which can be provided either as an automatically resettable device, a manually resettable device or a manually switchable device without adversely affecting the seal. Other objects and advantages will be in part apparent and in part pointed out hereinafter.

The invention accordingly comprises the elements and combination of elements, features of construction and arrangement of parts which will be exemplified in the structures hereinafter described, and the scope of the invention of which will be indicated in the appended claims.

Briefly, in accordance with the invention, first and second electric terminals are mounted in spaced apart apertures in the bottom wall of an open ended cup-shaped housing formed of electrically insulative material. A thermostatic, snap acting disc having a relatively narrow temperature differential, e.g., opening temperature of approximately 200° C. and a reset temperature of approximately 50° C., is cantilever mounted to one terminal and has an electric contact mounted on a free distal end for movement into and out of electrical engagement with an electric contact mounted on the other terminal as the disc moves between oppositely dished configurations. A flexible gasket is disposed over the open end of the housing with a lid received over and capturing the gasket to form a sealed, automatically resettable electric circuit breaker. The circuit breaker can be made into a manually resettable device by inserting a manual reset member into the housing prior to placement of the gasket over the top end of the housing. In one preferred embodiment, the reset member is formed of a metal plate of good spring material, such as a 300 series stainless steel, formed into a generally triangular configuration having a base with first and second legs having free ends. The base extends parallel and closely adjacent to the gasket and the first leg extends generally vertically downwardly toward the free distal end of the disc. Laterally extending tabs project from opposing sides of the member at one end of the base and are received in slots formed in the sidewalls of the circuit breaker housing so that a bias can be placed on the first leg toward the disc. A catch, in the form of a projection, is formed in the first leg which abuts the end of the disc when the contacts are in the engaged position and which moves under the disc when the disc moves to the contacts disengaged position to thereby prevent the disc from resetting. A lid having an opening therein mounting a force applying member, such as a vertically slidable reset button, is positioned over the gasket with the button aligned with a second, free end of the base of the reset member at a location spaced along the length of the base from the tabs. When the button is depressed the free end of the base is moved downwardly and the free end of the second leg engages the first leg and moves it away from the disc to thereby allow the disc to move to the contacts engaged position. Thus, the circuit breaker is made into a manually resettable device merely by dropping in a reset member thereby maintaining the integrity of the sealed gasket, and replacing a solid lid with a reset button mounting lid.

In a modified embodiment, the manually resettable member may be formed of a separate spring member combined with a pivotable trip arm which again can be merely dropped into the housing prior to the placement of the gasket.

The circuit breaker can be further modified to make it into a manually switchable device by, prior to placement of the gasket, dropping a laterally extending pin into slots formed in the sidewalls of the housing generally aligned with the center of the opening in a lid to be installed over the top end of the housing, and placing downwardly open bearing surfaces of a generally inflexible switch arm onto the pin. The switch arm has a free end formed with a reverse bend which is placed over the free end of the disc on either side of the contact. Extending from the opposite side of the bearing surface is a force receiving surface adapted to extend parallel and closely adjacent to the gasket. The gasket is positioned over the open end and a rocker member is placed in the opening of a lid and the lid attached to the housing. When one side of the rocker is depressed the force receiving surface is depressed causing the trip arm to move upwardly raising the free end of the disc and allowing the catch of the reset member to move underneath the disc to thereby prevent reclosure of the contacts. When the other side of the rocker is depressed the base of the reset member is displaced to force the catch away from the disc and allow reclosure of the contacts. As in the case of the manually resettable device, the gasket is not compromised in modifying the circuit breaker to make a manually switchable device. It will be appreciated that it is within the purview of the invention to install the switch arm without the manual reset member if it is desired to provide a momentary break device, that is, a device in which the circuit can be interrupted which the force applying member is held in the depressed position.

BRIEF DESCRIPTION OF THE DRAWINGS

In the accompanying drawings several of the preferred embodiments are illustrated. Similar reference characters indicate corresponding parts throughout the several views of the drawings.

DETAILED DESCRIPTION OF THE PREFERRED EMBODIMENTS

Figure 1:
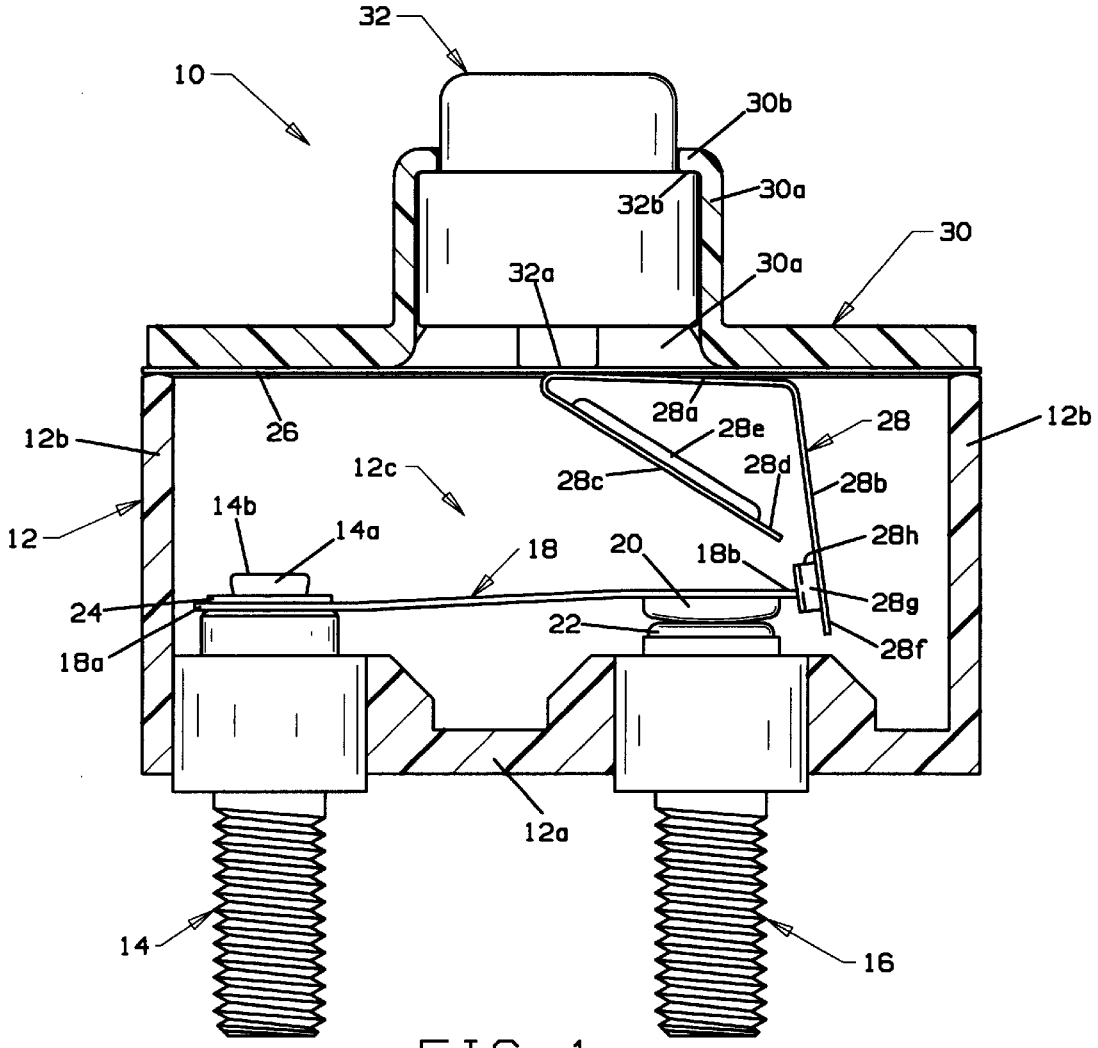
FIG. 1 is a cross sectional elevational view of a manually resettable circuit breaker made in accordance with a first embodiment of the invention, shown in the contacts engaged position.
Figure 2:
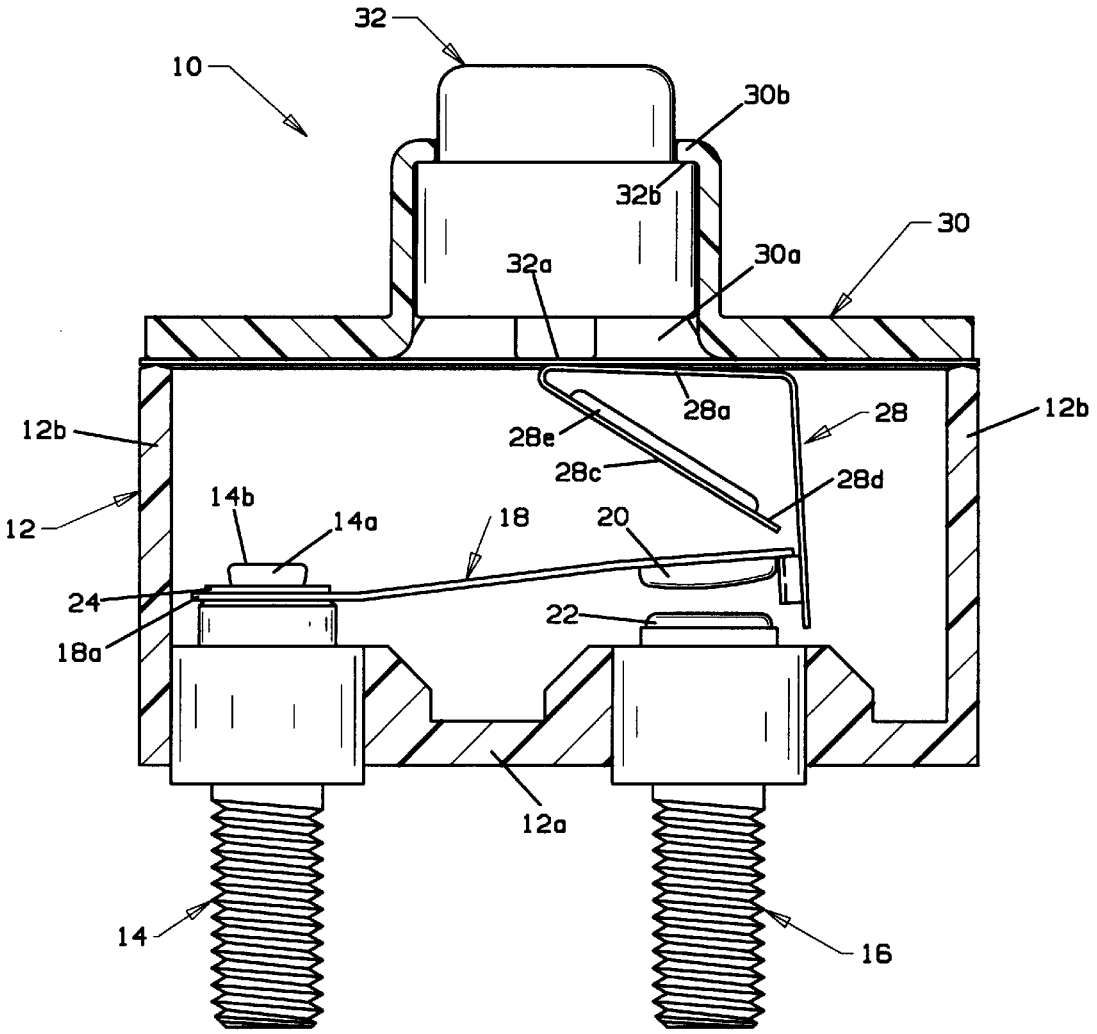
FIG. 2 is a view similar to FIG. 1 but shown in the contacts disengaged position.
Figure 3:
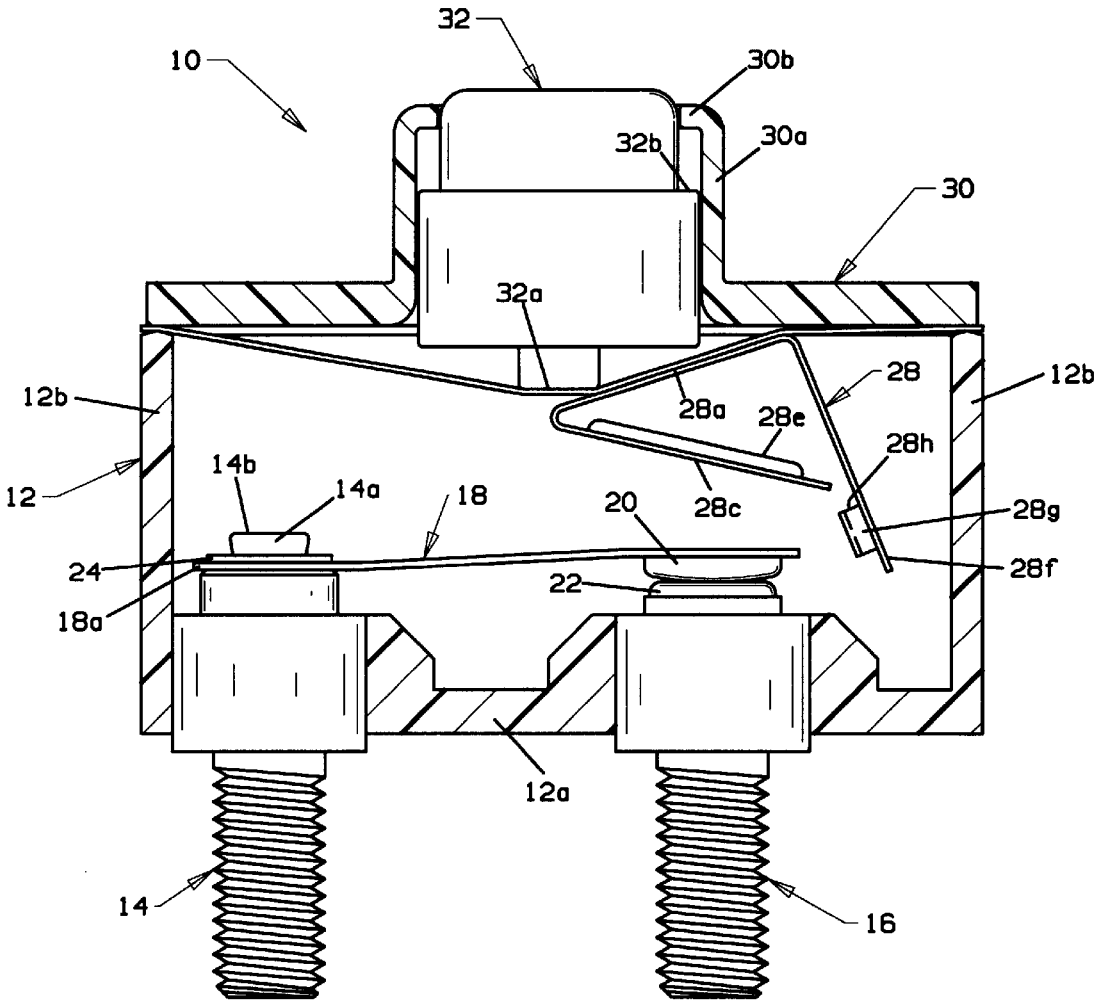
FIG. 3 is a view similar to FIG. 2 but shown with the manual reset button depressed allowing the contacts to move into engagement.

With reference to FIGS. 1–3, a manually resettable circuit breaker 10 made in accordance with the invention, comprises a generally cup-shaped housing 12 formed of electrically insulative material, such as thermoplastic, having a bottom wall 12*a* and upstanding sidewalls 12*b* forming an open end and defining a switch chamber 12*c*. First and second electrical terminals 14 and 16 extend into switch chamber 12*c* through spaced apart apertures in bottom wall 12*a*. A thermostatic, snap acting disc 18 composed of suitable bimetal or the like has one end 18*a* attached to terminal 14 in cantilever fashion with a movable electrical contact 20 mounted on a free end 18*b* by any suitable means, such as welding thereto, adapted to move into and out of electrical engagement with a stationary electrical contact 22 mounted on terminal 16. Disc 18 is formed into a dished shaped configuration so that it will snap between a first, downwardly concave configuration shown in FIG. 1 at a downwardly convex configuration shown in FIG. 2 in dependence upon preselected temperature levels of the disc. Although disc 18 can be attached to terminal 14 by any suitable means, as shown, an aperture with radially inwardly extending projections (see 18*c* in FIG. 6*a*) is formed in disc 18 adjacent end 18*a* with post 14*a* received through the aperture with the inwardly extending projections forming an interference fit. A washer 24 is then placed on post 14*a* over the disc and the post is headed over at 14*b* to form a secure physical and electrical connection.

The circuit breaker may be used as an automatically resettable device by forming the snap acting disc so that it actuates from the contacts engaged to a contacts disengaged position at a selected temperature, such as 200° C. and snaps back to the contacts engaged position upon cooling off to a lower selected temperature, such as 50° C. Generally, it is preferred to provide an environmental seal in the form of a gasket 26 which extends over the open end housing 12 and is captured by a suitable solid lid member (not shown) attached to the housing by any suitable means such as screws (not shown). Preferably, the gasket is formed of flexible material to facilitate its use with other versions of the circuit breaker to be discussed.

Figure 1A:
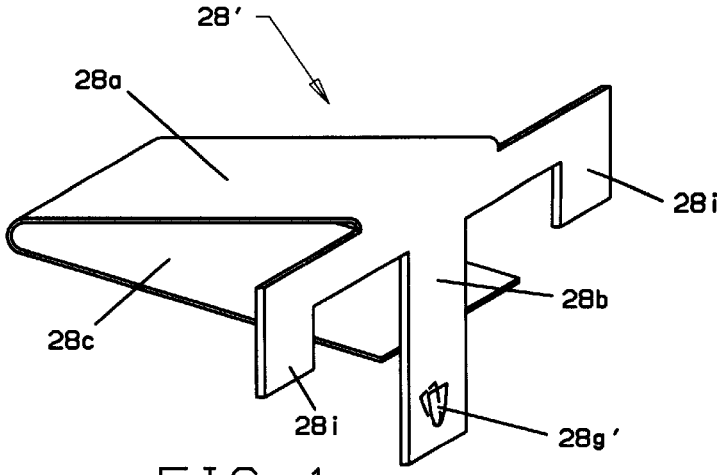
FIG. 1*a* is a perspective view of a variation of the manual reset member used in the FIG. 1 circuit breaker.

Circuit breaker 10 is made into a manually resettable device by dropping in manual reset member 28 prior to the placement of gasket 26. Manual reset member 28 is formed of suitable spring material, such as a sheet of 300 series stainless steel formed into a generally triangular configuration having a base 28*a*, a generally vertically, downwardly extending first leg 28*b* and a second leg 28*c* extending downwardly and transversely along base 28*a* toward first 28*b*. Second leg 28*c* has a free distal end 28*d* which is spaced slightly from first leg 28*b*, in its at rest, non-biased condition, at a point intermediate the ends of first leg 28*b*. If desired, suitable strengthening means may be provided for second leg 28*c*, such as rib 28*e* to prevent bending of the leg when subjected to compressive forces as will be described. First leg 28*b* has a free distal end 28*f* which extends downwardly beyond second leg 28*c* and is provided with a disc catch 28*g* adjacent to the free distal end 28*f*. Catch 28*g* is in the form of a generally rectangular projection viewed from the top forming a platform 28*h*, however, other catches can be employed, such as a lanced tab 28*g'* shown in FIG. 1*a*. Manual reset member 28 is formed with a pair of mounting tabs 28*i* (see FIG. 1*a*) laterally disposed on either side of the member adjacent to an end of base 28*a* and receivable in a vertically extending slot formed in opposite portions of sidewalls 12*b* of housing 12. After manual reset member 28 is installed in housing 12, flexible gasket 26 is placed over the open end of the housing and a lid 30 is disposed over the gasket and attached to sidewalls 12*b* to form an environmental seal. Lid 30 is provided with a centrally located opening 30*a* for receipt of a force applying member such as reset button 32 which is vertically slidable in tubular portion 30*a*. Force applying surface 32*a* is received on top of gasket 26 with its outward position limited by flange 30*b* interacting with shoulder 32*b* of tubular portion 30*a* and is aligned with base 28*a* of manual reset member 28*a*, preferably adjacent to second leg 28*c*. As shown in FIG. 1, disc 18 is in the contacts engaged position with projection 28*g* biased against the edge of the disc. When the temperature of disc 18 reaches the actuation temperature caused by $I^2R$ heating due to a current overload of a preselected level and duration, the disc will snap to the contacts disengaged position shown in FIG. 2 with second leg 28*b* moving clockwise into engagement with second leg 28*b* received above projection 28*g*. When the disc cools off to the so called reset temperature it will be prevented from moving to the contacts engaged position by projection 28*g*, as seen in the drawing, with projection 28*g* disposed beneath the disc and the disc lying on the platform 28*h*. In order to reset the circuit breaker, button 32 is depressed forcing gasket 26 to deflect and base 28*a* to pivot counter clockwise as seen in FIG. 3 with distal free end 28*d* engaging first leg 28*b* and displacing the leg and projection 28*g* so that the disc is free to move to the FIG. 1, contacts engaged, position.

Figure 4:
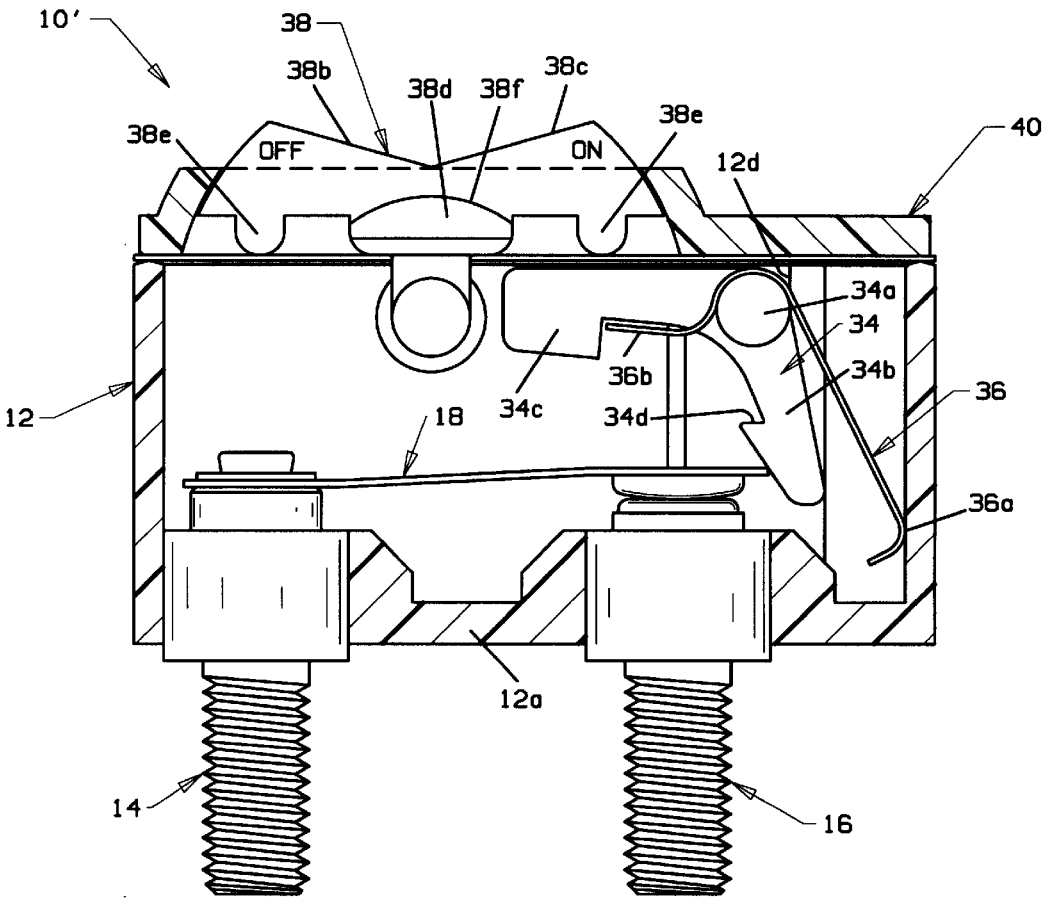
FIG. 4 is a view similar to FIG. 1, but in a smaller scale, showing a modified reset member, and a force applying rocker and shown without a sealing gasket for ease of illustration.
Figure 4A:
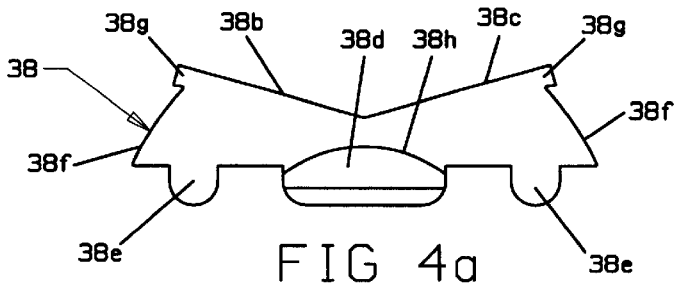
FIG. 4*a* is a front elevational view of the force applying rocker of FIG. 4.
Figure 4B:
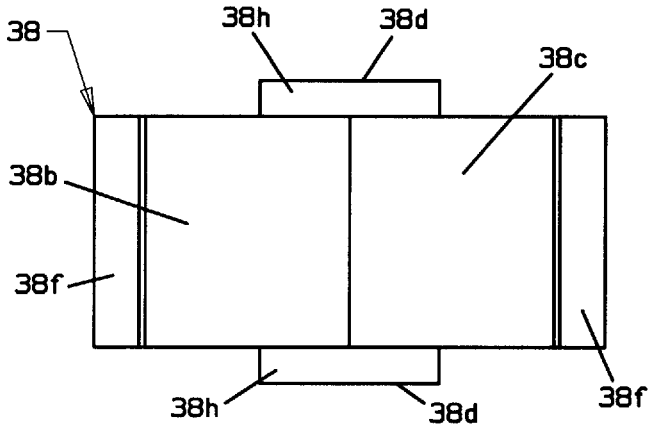
FIG. 4*b* is a top plan view of the FIG. 4*a* rocker.
Figure 4C:
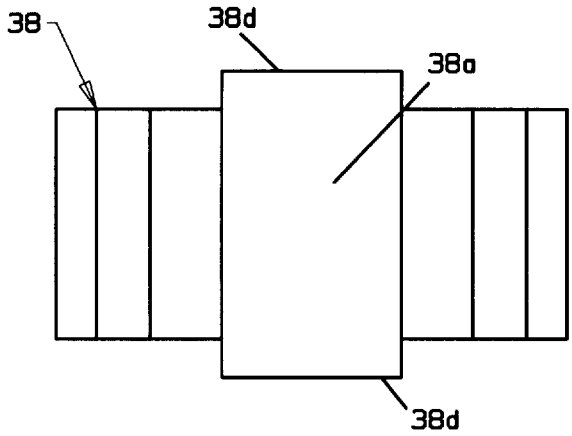
FIG. 4*c* is a bottom plan view of the FIG. 4*a* rocker.
Figure 4D:
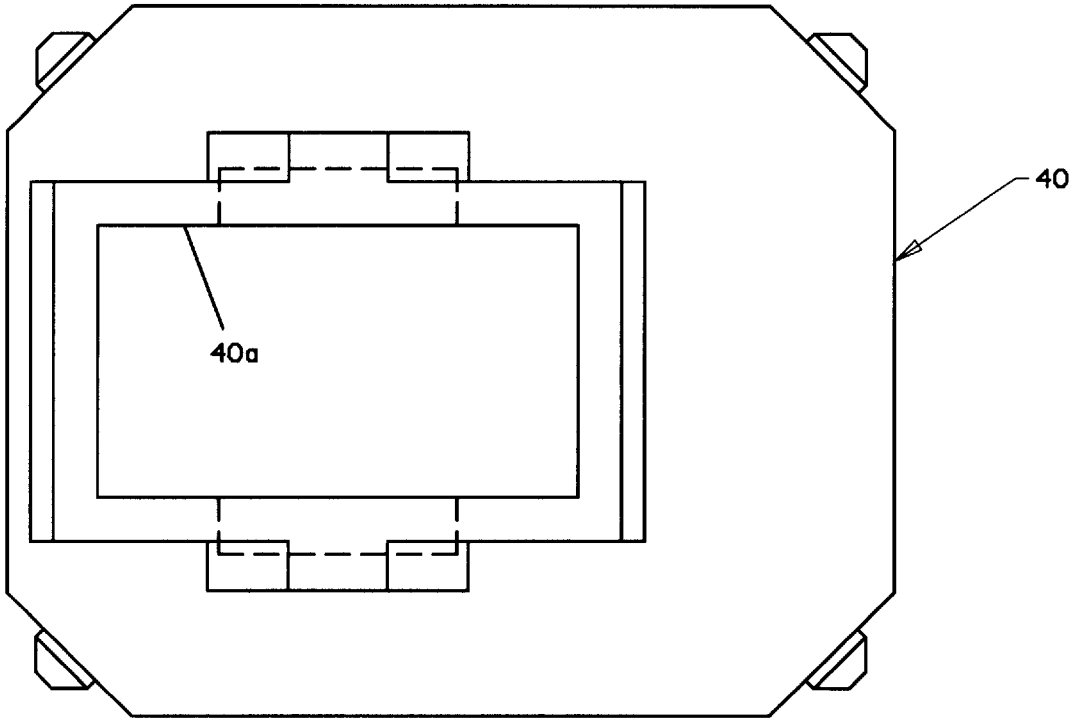
FIG. 4*d* is a top plan view of the FIG. 4 structure.
Figure 4E:
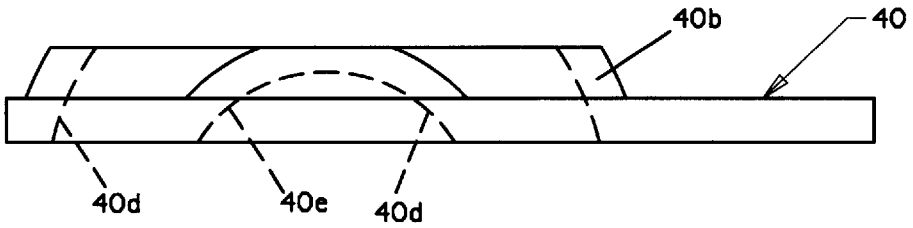
FIG. 4*e* is a front elevational view of the lid of the FIG. 4 circuit breaker.

A modification of the FIGS. 1–3 embodiment is shown in FIG. 4 in which the manual reset member comprises a pivotable arm 34 and a separate spring member 36. Arm 34 has opposed journals 34*a* received in slots 12*d* formed in sidewalls 12*b*, a first leg 34*b* on one side of the pivot and a second, force receiving leg 34*c* in an opposite side of the pivot. As in the FIGS. 1–3 embodiment, the force receiving surface lies parallel and closely adjacent to gasket 26 (not shown). A catch 34*d* is provided on first leg 34*b* while spring 36 has one end 36*a* reacting against sidewall 12*b* and an opposite end 36*b* biased against second leg 34*c* of arm 34 with a clockwise force, as seen in FIG. 4, placed on arm 34. Circuit breaker 10' is also shown with a rocker element 38 although push button 32 could be used if desired. With reference to FIGS. 4*a*–4*e*, rocker element 38 has laterally extending mounting portions 38*a* having a generally flat lower surface and extending beyond the force applying button surfaces to form laterally spaced ears 38*d* formed with a curved upper surface 38*f*. Laterally extending force applying ribs 38*e* extend downwardly adjacent opposed ends of rocker element. Lid 40 is provided with an opening 40*a* of a size selected to receive rocker element 38 with a rim 40*b* disposed about the periphery thereof. End portions 40*c* of rim 40*b* are formed with a radiused surface 40*d* matching radiused surface 30*f*. A recessed portion is formed in the bottom surface of lid 40 on opposed sides and have a concave radiused surface portion 40*e* (see FIG. 4*e*) matching that of convex radiused surface portion 38*d*. In assembling the device the rocker element is captured between gasket 26, omitted for purposes of illustration in FIG. 4, and lid 40 within opening 40*a* and with ears 38*d* being pivotably confined by radiused surface portion 40*e*.

It will be seen that by depressing portion 38*c* of rocker element 38, rib 38*e* will deflect the gasket and move reset member 34 counter clockwise to allow the disc, captured by catch 34*d* upon contacts disengagement, to return to the contacts engaged position.

Figure 5:
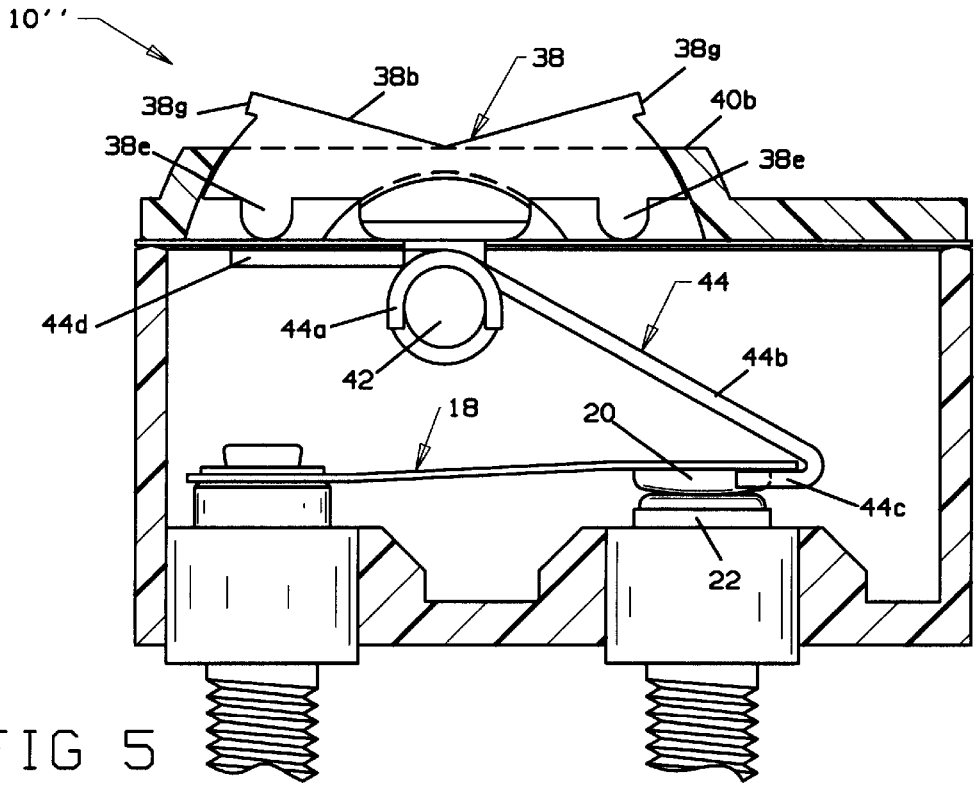
FIG. 5 is a view similar to FIG. 4 showing a momentary break, automatic reset circuit breaker made in accordance with another embodiment of the invention.

A modified embodiment is shown in FIG. 5 in which a momentary break mechanism is provided without a manual reset member. The momentary break mechanism comprises a pin 42 received in opposite slots in sidewall 12*b* and a relatively inflexible switch arm 44 having downwardly open pivot surfaces 44*a* received on pin 42, a first switch arm portion 44*b* extending from one side of the pivot surface, the switch arm portion having a free distal end formed with a reverse bend 44*c*, preferably bifurcated and placed beneath disc 18 on either side of contact 20. A force receiving portion 44*d* extends from pivot surface in a direction opposite to switch arm portion 44*b* and extends parallel and closely adjacent to gasket 26 (not shown in FIG. 5) and in alignment with a force applying rib 38*e*. By depressing side 38*b* of rocker element 38, the free end if disc 18 is lifted to separate the electrical contacts and interrupt the circuit path for as long as side 38*b* is depressed. It will be understood that the pin 42 and switch arm 44 can be combined into a single element, if desired.

Figure 6:
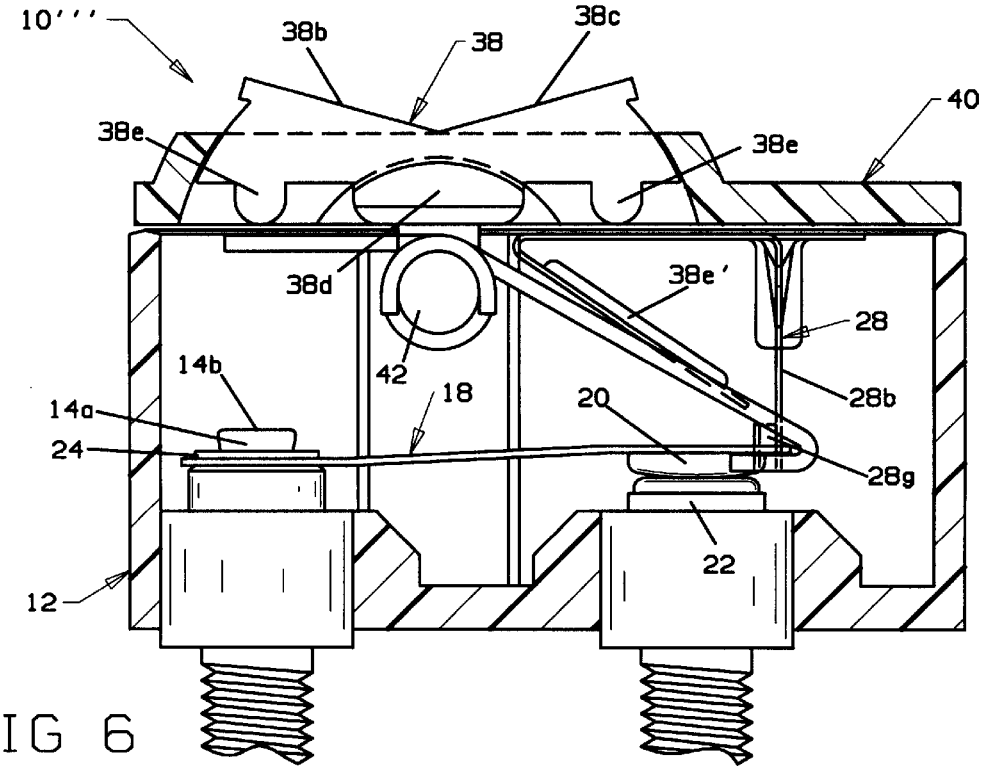
FIG. 6 is a view similar to FIG. 4 showing a manual resettable circuit breaker provided with a manually switchable feature and shown with the reset member in an at rest position as if the disc were not present.
Figure 6A:
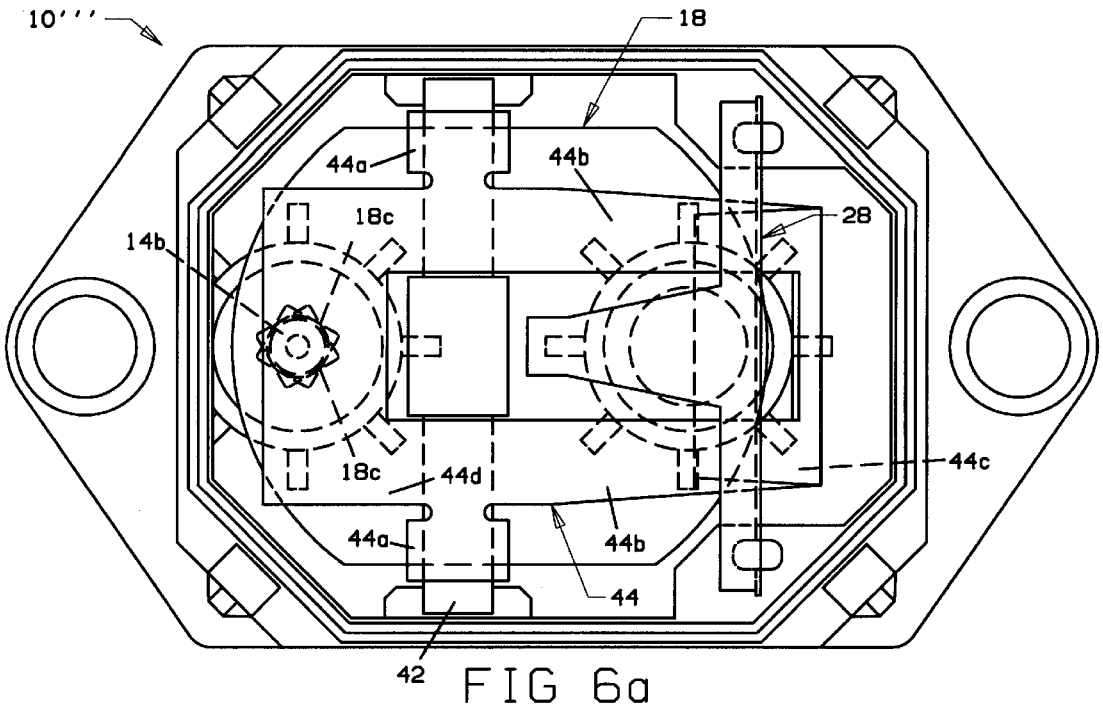
FIG. 6*a* is a top plan view of the FIG. 6 circuit breaker with the lid and force applying rocker removed.
Figure 7:
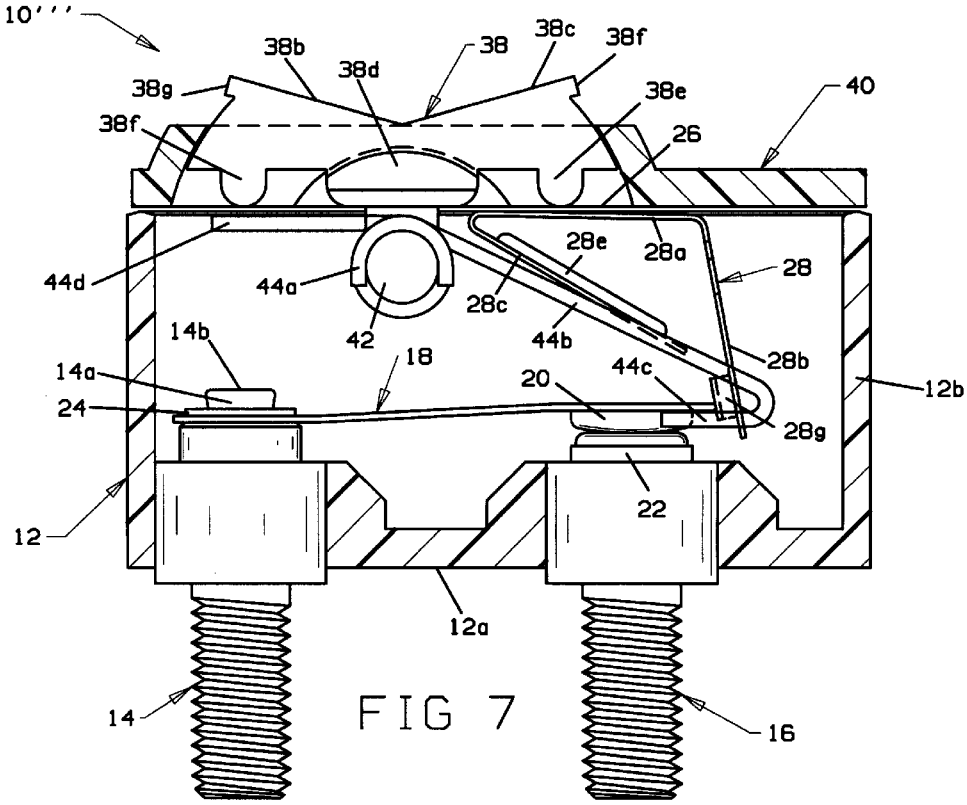
FIG. 7 is a view similar to FIG. 1 showing the FIG. 6 circuit breaker in the contacts engaged position with the catch of the reset member biased against the disc.
Figure 8:
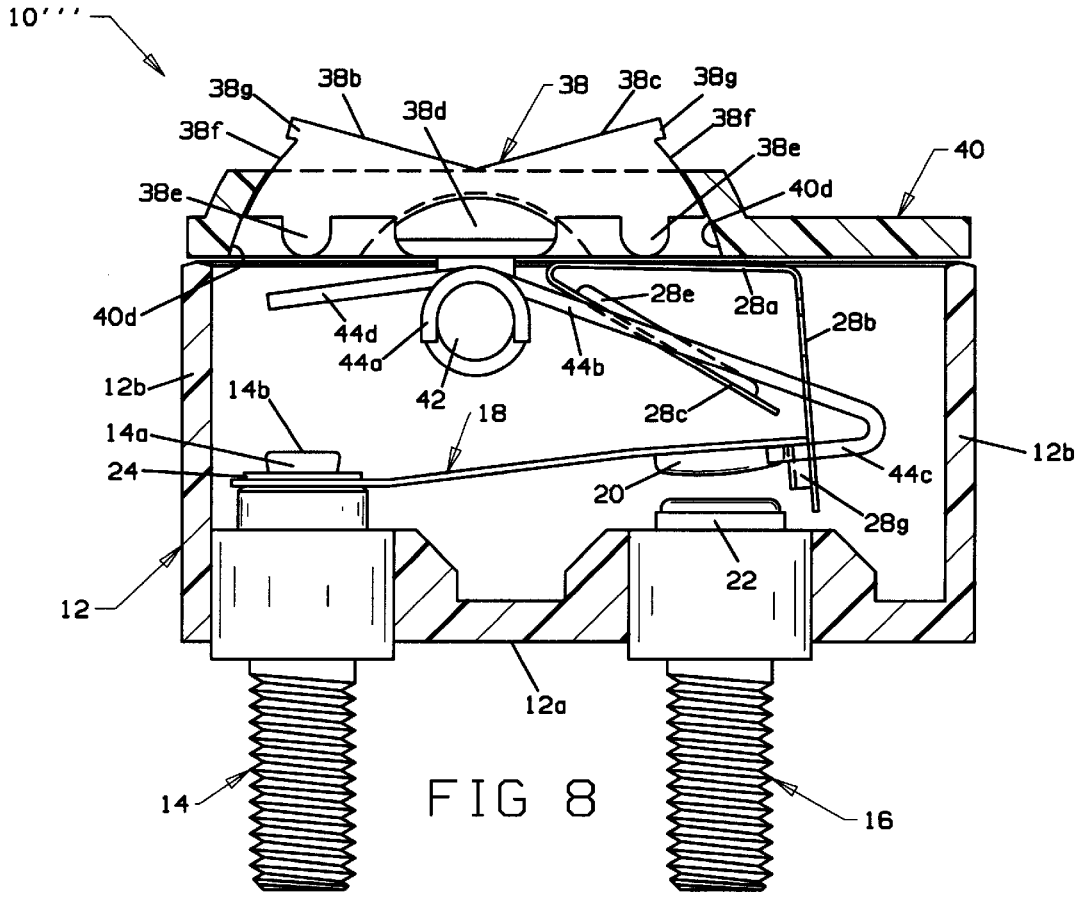
FIG. 8 is a view similar to FIG. 7 but shown with the disc in the contacts disengaged position and with the catch of the reset member positioned under the disc preventing reclosure of the contacts.
Figure 9:
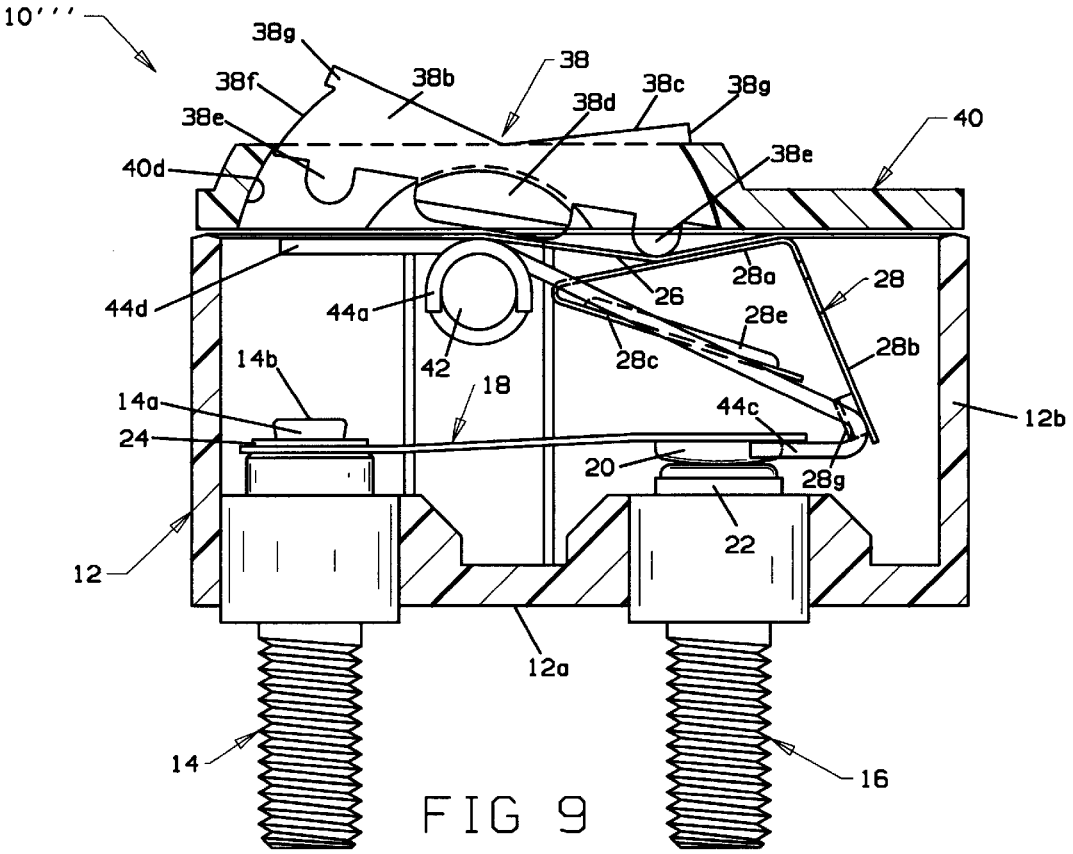
FIG. 9 is a view similar to FIG. 7 shown with the reset side of the force applying rocker depressed which moved the catch away from the disc allowing the contacts to move to the contacts engaged position.
Figure 10:
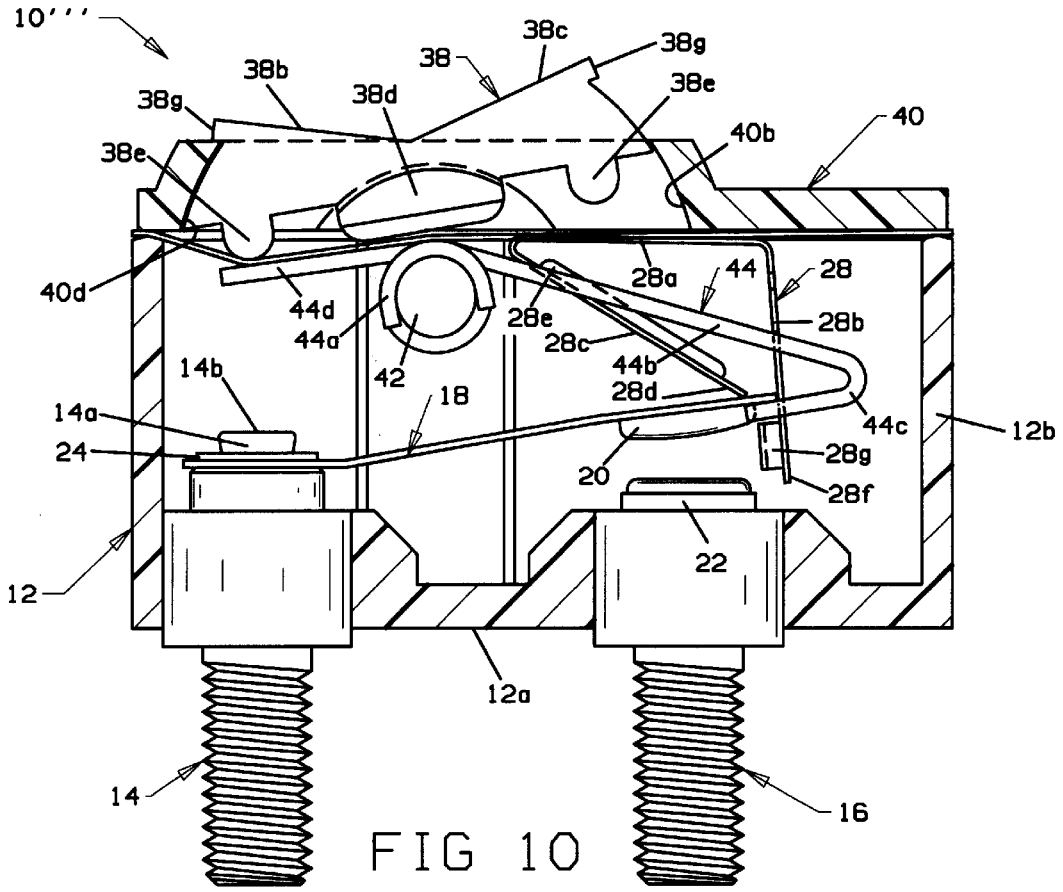
FIG. 10 is a view similar to FIG. 7 shown with the manually switchable side of the force applying rocker depressed lifting the disc to allow the catch of the reset member to move beneath the disc.

The circuit breaker can be made into a manually resettable, manually switchable device by combining the FIG. 5 feature with that of FIGS. 1–3, as seen in FIG. 6 which shows first leg 28*b* and catch 28*g* in an at rest position as if disc 18 were not present. In the contacts engaged position, projection 28*g* is biased against the edge of disc 18 as shown in FIG. 7. When side 38*b* of rocker element 38 is depressed (FIG. 10) lifting the free end of disc 18, or when the disc reaches the actuation temperature and snaps to its opposite configuration with the contacts disengaged, catch 28*g* moves under the disc as shown in FIG. 8 to prevent reengagement of the contacts as described in the FIGS. 1–3 embodiment until side 38*c* of the rocker element is depressed (FIG. 9) to move first leg 28*b* and catch 28*g* away from the disc thereby allowing the contacts to move into engagement when the disc has cooled to the reset temperature.

It will be seen that circuit breakers made in accordance with the invention are easy to assemble utilizing drop-in parts, having an environmental seal which is not comprised, as in the prior art, by having elements penetrate the flexible gasket. In view of the above, it will be seen that the several objects of the invention are achieved and other advantageous results attained.

As many changes could be made in the above constructions without departing from the scope of the invention, it is intended that all matter contained in the above description or shown in the accompanying drawings, can be interpreted as illustrative and not in a limiting sense.

What is claimed is:

1. A current responsive electric circuit breaker comprising a generally cup shaped housing member having a bottom wall, sidewalls extending upwardly from the bottom wall to circumscribe a switching chamber and an open top, the bottom wall formed with first and second apertures therethrough, first and second electric terminals received in the respective apertures, an electrically conductive, snap acting thermostatic disc having first and second oppositely dished configurations, the disc having an end fixed to the first terminal and having a free distal end, an electric contact mounted on the disc adjacent the free distal end and being movable into and out of electrical engagement with the second terminal, the disc normally being in a downwardly facing concave configuration with the movable contact in electrical engagement with the second terminal when the temperature is below a selected level and being in a downwardly facing convex configuration with the movable contact out of electrical engagement with the second terminal when the temperature is above a selected actuation temperature level, a manual reset member having a force receiving portion, a leg extending downwardly from the reset member to a free distal end and being biased toward the disc, a disc catch formed on the first leg adjacent the free distal end thereof and normally being disposed beneath the free distal end of the disc when the disc is in the downwardly facing convex configuration to prevent the movable contact from moving into electrical engagement with the second terminal, the manual reset member mounted in the cup shaped housing member aligned with and above the disc, a flexible gasket received on the sidewalls and closing the open top of the housing member, a lid received on the sidewalls over the gasket, the lid having an opening, a force applying member movably mounted in the opening, the force applying member being movable to apply a force through the flexible gasket to depress the force receiving portion of the manual reset member thereby moving the free distal end of the leg to move the disc catch away from the disc to allow the disc to snap to the downwardly facing concave configuration with the movable contact in electrical engagement with the second terminal.

2. A current responsive electric circuit breaker according to claim 1 in which the downwardly extending leg is a first leg extending from an end of the force receiving portion and further comprising a second leg which extends downwardly from a second end of the force receiving portion toward the first leg and having a free distal end spaced form the first leg when no force is applied to the force receiving portion, the force from the force applying member moving the free distal end of the second leg into engagement with the first leg to move the disc catch away from the disc.

3. A current responsive electric circuit breaker according to claim 1 in which the force applying member is a button slidable in a vertical direction relative to the force receiving portion.

4. A current responsive electric circuit breaker according to claim 1 in which laterally disposed slits are formed in the sidewalls of the housing and the reset member has laterally disposed portions received in the slots to mount the reset member in the housing.

5. A current responsive electric circuit breaker according to claim 1 in which the disc catch is a protrusion extending from the leg.

6. A current responsive electric circuit breaker according to claim 2 in which the second leg has a rib formed therein to stiffen the second leg.

7. A current responsive electric circuit breaker according to claim 1 in which a pin seat is formed in opposing sides of the sidewalls and further comprising a pivotable shaft portion received in the pin seat, a relatively inflexible switch arm extending from the shaft portion toward the free end of the disc and having a free distal end formed with a reverse bend received under a portion of the free end of the disc, a force applying surface portion extending from the shaft portion in a direction opposite from that of the switch arm, the force applying surface portion lying parallel and closely adjacent to the gasket, the force applying member being a pivotable rocker element pivotable in one direction to apply a force to the force receiving surface portion attached to the shaft portion to raise the free end of the disc allowing the catch of the manual reset member to move under the disc and being pivotable in the opposite direction to apply a force to the force receiving portion of the manual reset member.

8. A current responsive electric circuit breaker according to claim 7 in which the free distal end of the switch arm is bifurcated with portions received on either side of the movable electric contact.

9. A current responsive electric circuit breaker according to claim 7 in which the shaft portion is a pin and the switch arm and force receiving surface portion are formed from a member having downwardly open bearing surfaces received on the pin.

10. A current responsive electric circuit breaker according to claim 7 in which the rocker element has opposed ears captured by the lid.

11. A current responsive electric circuit breaker according to claim 7 in which the rocker element has stop surfaces to prevent over travel of the rocker element upon pivoting thereof.

12. A current responsive electric circuit breaker comprising a generally cup shaped housing having a bottom wall, sidewalls extending upwardly from the bottom wall to circumscribe a switching chamber and an open top, the bottom wall formed with first and second apertures therethrough, first and second electric terminals received in the respective apertures, an electrically conductive, snap acting thermostatic disc having first and second oppositely dished configurations, the disc having an end fixed to the first terminal and having a free distal end, an electric contact mounted on the disc adjacent the free distal end and being movable into and out of electrical engagement with the second terminal, the disc normally being in a downwardly facing concave configuration with the movable contact in electrical engagement with the second terminal when the temperature is below a selected level and being in a downwardly facing convex configuration with the movable contact out of electrical engagement with the second terminal when the temperature is above a selected actuation temperature level, a manual reset member having a central force receiving portion having first and second ends, a first leg extending downwardly from the first end of the central force receiving portion to a free distal end and being biased toward the disc, a disc catch formed on the first leg adjacent the free distal end thereof and normally being disposed beneath the free distal end of the disc when the disc is in the downwardly facing convex configuration to prevent the movable contact from moving into electric engagement with the second terminal, a second leg extending downwardly from the second end of the central force receiving portion and toward the first leg, the manual reset member mounted in the cup shaped housing member aligned with and above the free distal end of the disc, a flexible gasket received on the sidewalls and closing the open top of the housing member, a force applying member movably mounted on the housing being movable to apply a force through the flexible gasket to depress the central force receiving portion thereby moving the free distal end of the second leg into engagement with the first leg to move the disc catch away from the disc to allow the disc to snap to the downwardly facing concave configuration with the movable contact in electrical engagement with the second terminal.

13. A current responsive electric circuit breaker comprising a generally cup shaped housing member having a bottom wall, sidewalls extending upwardly from the bottom wall to circumscribe a switching chamber and an open top, the bottom wall formed with first and second apertures therethrough, first and second electric terminals received in the respective apertures, an electrically conductive, snap acting thermostatic disc having first and second oppositely dished configurations, the disc having an end fixed to the first terminal and having a free distal end, an electric contact mounted on the disc adjacent to the free distal end and being movable into and out of electrical engagement with the second terminal, the disc normally being in a downwardly facing concave configuration with the movable contact in electrical engagement with the second terminal when the temperature is below a selected level and being in a downwardly facing convex configuration with the movable contact out of electrical engagement with the second terminal when the temperature is above a selected actuation temperature level, a pin seat formed in opposing sides of the sidewalls, a pivotable shaft portion received in the pin seat, a relatively inflexible switch arm extending from the shaft portion toward the free end of the disc and having a free distal end formed with a reverse bend received under a portion of the disc, a force receiving surface portion extending from the shaft portion in a direction opposite to that of the switch arm, the force receiving surface portion lying parallel and closely adjacent to the gasket, a flexible gasket received on the sidewalls closing the open top and a force applying member mounted on the housing and being movable against the gasket to apply a force to the force receiving surface portion attached to the shaft portion to raise the free end of the disc.

* * * * *